US007937788B2

(12) United States Patent
Felix

(10) Patent No.: US 7,937,788 B2
(45) **Date of Patent: *May 10, 2011**

(54) MODULAR FOUNDATION ASSEMBLY FOR BEDS

(75) Inventor: Arthur R. Felix, Downey, CA (US)

(73) Assignee: Felix Manufacturing Company, Inc., Compton, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 12/490,166

(22) Filed: Jun. 23, 2009

(65) Prior Publication Data

US 2009/0271925 A1 Nov. 5, 2009

Related U.S. Application Data

(63) Continuation of application No. 11/325,402, filed on Jan. 3, 2006, now abandoned.

(51) Int. Cl.
*A47C 19/00* (2006.01)
*A47C 23/00* (2006.01)

(52) U.S. Cl. ..... 5/201; 5/282.1; 5/285; 5/286

(58) Field of Classification Search ..... 5/201, 282.1, 5/288, 286, 285, 305, 292, 304, 310
See application file for complete search history.

(56) References Cited

U.S. PATENT DOCUMENTS 25,563 A 9/1859 Eaton
318,282 A 5/1885 Moore
4,613,999 A 9/1986 Franco et al.
4,617,689 A 10/1986 Nelson et al.
4,734,946 A 4/1988 Saputo
4,870,711 A 10/1989 Felix
5,095,565 A 3/1992 Brown
5,099,529 A * 3/1992 Anderson ..... 5/400
5,289,600 A 3/1994 Schermel
(Continued)

FOREIGN PATENT DOCUMENTS

DE 1 206 128 12/1965
(Continued)

OTHER PUBLICATIONS

Internation Search Report and Written Opinion of the International Searching Authority dated Jun. 28, 2007, for International Application No. PCT/US2007/000075; filed Jan. 3, 2007.

*Primary Examiner* — Jonathan J Liu
(74) *Attorney, Agent, or Firm* — Christie, Parker & Hale, LLP

(57) ABSTRACT

A modular bed frame has ladder-like side frames with upper and lower side rails, and ladder-like end frames with upper and lower rails. The side and end frames telescopingly attach to the ends of upper and lower rounded corner rails. The insides of the side frames carry tubular upright fittings for increasing vertical rigidity. These fittings also provide upwardly opening tubular sleeves that receive right angle corner connectors on the ends of spaced apart and parallel horizontal slats that traverse the bed frame from end to end when assembled by a user. Separate upright rigid legs with feet on the bottom are slidably attached to downwardly opening tubular sleeves on the underside of the assembled frame structure to elevate the assembled bed foundation above the floor.

11 Claims, 6 Drawing Sheets

U.S. PATENT DOCUMENTS

| | | | | |
|---|---|---|---|---|
| 5,459,892 | A | | 10/1995 | Wells et al. |
| 5,469,589 | A | | 11/1995 | Steed et al. |
| 5,564,140 | A | | 10/1996 | Shoenhair et al. |
| 5,701,653 | A | * | 12/1997 | Rupe ..... 29/432 |
| 5,758,372 | A | * | 6/1998 | Lopez Diaz ..... 5/200.1 |
| 5,983,423 | A | | 11/1999 | Rupe |
| 6,125,484 | A | | 10/2000 | Thomson |
| 6,286,161 | B1 | | 9/2001 | McCall |
| 6,615,425 | B1 | | 9/2003 | Candell |
| 6,711,765 | B1 | * | 3/2004 | Mitchell et al. ..... 5/202 |
| 6,832,397 | B2 | | 12/2004 | Gaboury et al. |
| 6,883,191 | B2 | | 4/2005 | Gaboury et al. |
| 6,925,666 | B2 | | 8/2005 | Harrow |

FOREIGN PATENT DOCUMENTS

| | | | | |
|---|---|---|---|---|
| DE | 1 994 798 | | | 10/1968 |
| EP | 0 198 610 | A2 | | 10/1986 |
| FR | 544 509 | | | 9/1922 |
| FR | 918 304 | | | 2/1947 |
| FR | 1 218 839 | | | 5/1960 |
| FR | 1 276 390 | | | 11/1961 |
| FR | 2 642 288 | | | 8/1990 |
| GB | 2 129 903 | A | | 5/1984 |
| GB | 2172198 | | * | 9/1986 |

* cited by examiner

MODULAR FOUNDATION ASSEMBLY FOR BEDS

CROSS-REFERENCE TO RELATED APPLICATION

This application is a continuation of U.S. patent application Ser. No. 11/325,402, filed Jan. 3, 2006, now abandoned which is incorporated herein by this reference.

FIELD OF THE INVENTION

This invention relates to foundations for use with mattresses in the bedding field, and more particularly, to a modular mattress-supporting foundation made of metal components easily assembled into a foundation which can replace the conventional frame and box spring assembly.

BACKGROUND OF THE INVENTION

Mattress-supporting foundations for conventional box springs are often made of wood frame members with a cloth outer cover. The conventional box springs are large and heavy. They require considerable storage space and therefore are expensive in stocking in inventory, especially in different sizes; and they have a high cost for transporting them from the factory to the customer or mattress manufacturer. Improvements are always sought in the expense of manufacturing, handling, assembling, and transporting bed foundations, and in the quality of the end product.

The present invention provides a metal bed foundation assembly manufactured in modular form and capable of being transported and assembled by the customer. The assembly components can be manufactured at a reasonably low cost while providing a high quality end product. The assembly avoids the retailer's cost of stocking conventional fully assembled box springs in inventory and the related higher cost of transporting them to the retailer or the user.

SUMMARY OF THE INVENTION

Briefly, one embodiment of this invention provides a metal foundation assembly for a bed which comprises a modular system of tubular metal components which are easily assembled into the finished foundation. The components of the assembly are interconnected by slidably attaching them with end connectors that engage corresponding connector sleeves so that the entire foundation, in one embodiment, can be fully assembled without conventional fasteners.

One embodiment of the invention provides a modular foundation assembly having ladder-like side frames with upper and lower side rails and ladder-like end frames with upper and lower end rails. Separate corner connectors are attached to the ends of the side frames and end frames at the corners of the assembled foundation. The corner connectors, in one embodiment, include upper and lower corner rails each formed with a right angle bend. The side and end frames slidably attach to the corresponding tubular fittings at the ends of upper and lower corner rails. The assembled corner connectors hold the side frames and end frames together to form a rectangular box-frame structure. The insides of the side frames carry tubular fittings formed as slat connector sleeves for connection to slats assembled between the side frames. The slat connector sleeves receive corner connectors on the ends of spaced apart slats that traverse the width of the box-frame structure when assembled by the user. The slats extend parallel to one another, perpendicular to the side frames, to provide lateral rigidity between the side frames. Elevating feet can be positioned at least near the four corners of the assembled frame structure for elevating the assembled foundation above the floor. In one embodiment, the elevating feet having leg sections which are slidably connected to sleeve-like tubular fittings on the undersides of the side frames.

These and other aspects of the invention will be more fully understood by referring to the following detailed description and the accompanying drawings.

DETAILED DESCRIPTION

Figure 1:
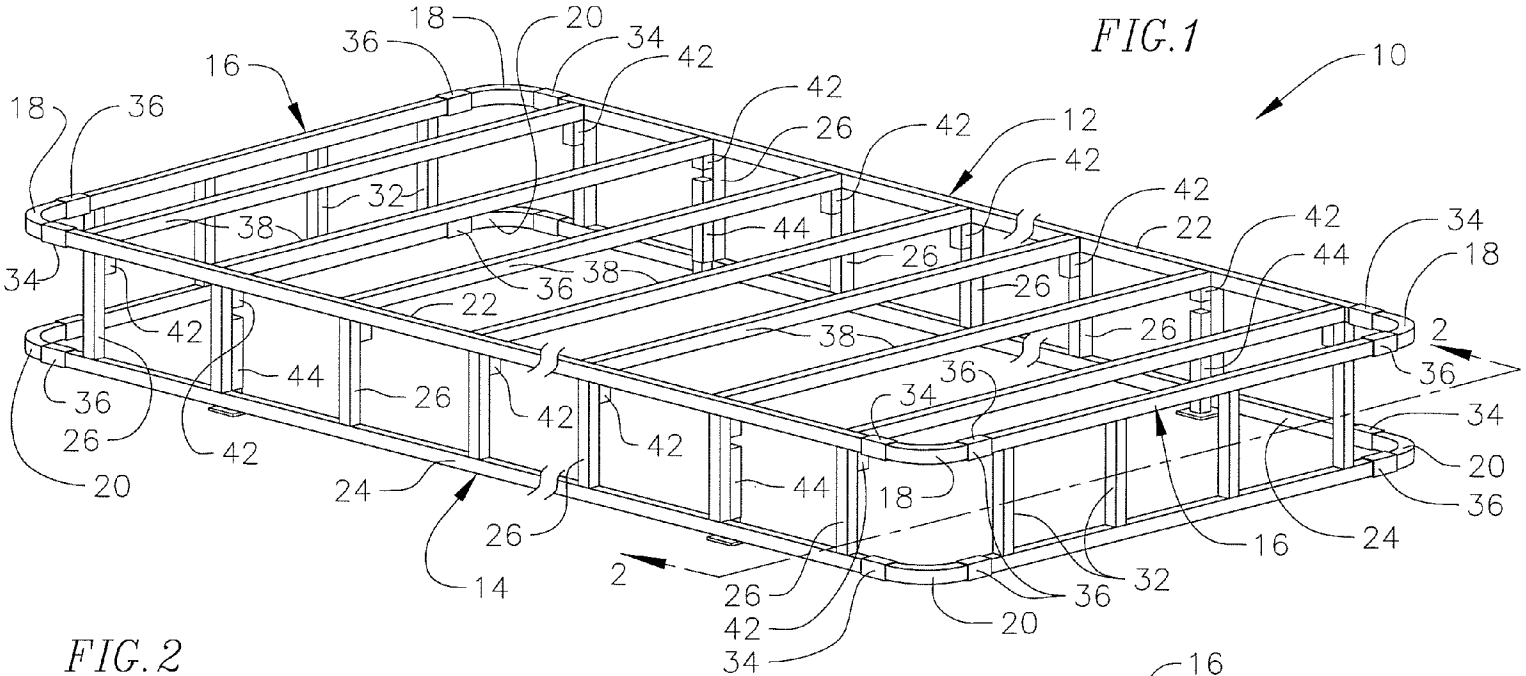
FIG. 1 is a fragmentary perspective view showing an assembled metal bed foundation according to principles of this invention.
Figure 2:
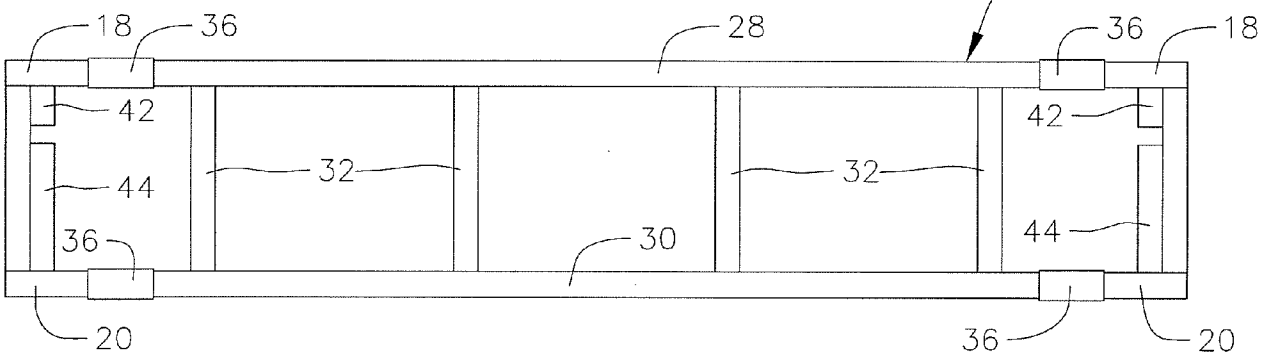
FIG. 2 is an end elevational view taken on line 2-2 of FIG. 1.

Referring to FIGS. 1 and 2, a modular bed foundation assembly 10 includes left and right ladder-like side frames 12 and 14 respectively, ladder-like end frames 16, a set of four upper corner connectors 18, and a similar set of four lower corner connectors 20. The corner connectors are releasably secured to corresponding upper and lower end portions of the side frames and adjacent upper and lower end portions of the end frames at the four corners of the assembled foundation. The upper corner connectors each releasably connect a corresponding upper end portion of one of the side frames with an upper end portion of an adjacent end frame. Similarly, the lower corner connectors each releasably connect a corresponding lower end portion of one of the side frames with a lower end portion of an adjacent end frame. The corner connectors are assembled at the four corners of the foundation to rigidly hold the right and left side frames 12 and 14 in a fixed laterally spaced apart position, extending parallel to one another, while rigidly holding the end frames 16 in a fixed longitudinally spaced apart position, parallel to one another, at opposite ends of the assembled rectangular box-frame foundation assembly.

The left and right side frames each include corresponding upper and lower elongated tubular rigid metal side members 22 and 24, respectively, spaced apart vertically and extending substantially parallel to one another. A plurality of corresponding longitudinally spaced apart first rigid metal bracing members 26 are affixed in upright positions and extend parallel to one another to support the upper and lower tubular side members of each side frame. The first rigid metal bracing members 26 are preferably tubular metal frame members welded at opposite ends to the upper and lower side members.

The left and right end frames 16 each comprise corresponding upper and lower elongated tubular rigid metal end members 28 and 30. respectively, spaced apart vertically and extending parallel to one another. A plurality of corresponding laterally spaced apart second rigid metal bracing members 32 are rigidly affixed in upright positions extending parallel to one another for supporting the upper and lower tubular end members of each end frame. The second rigid metal bracing members 32 are preferably tubular metal frame members welded at opposite ends to the upper and lower end members.

Figure 3:
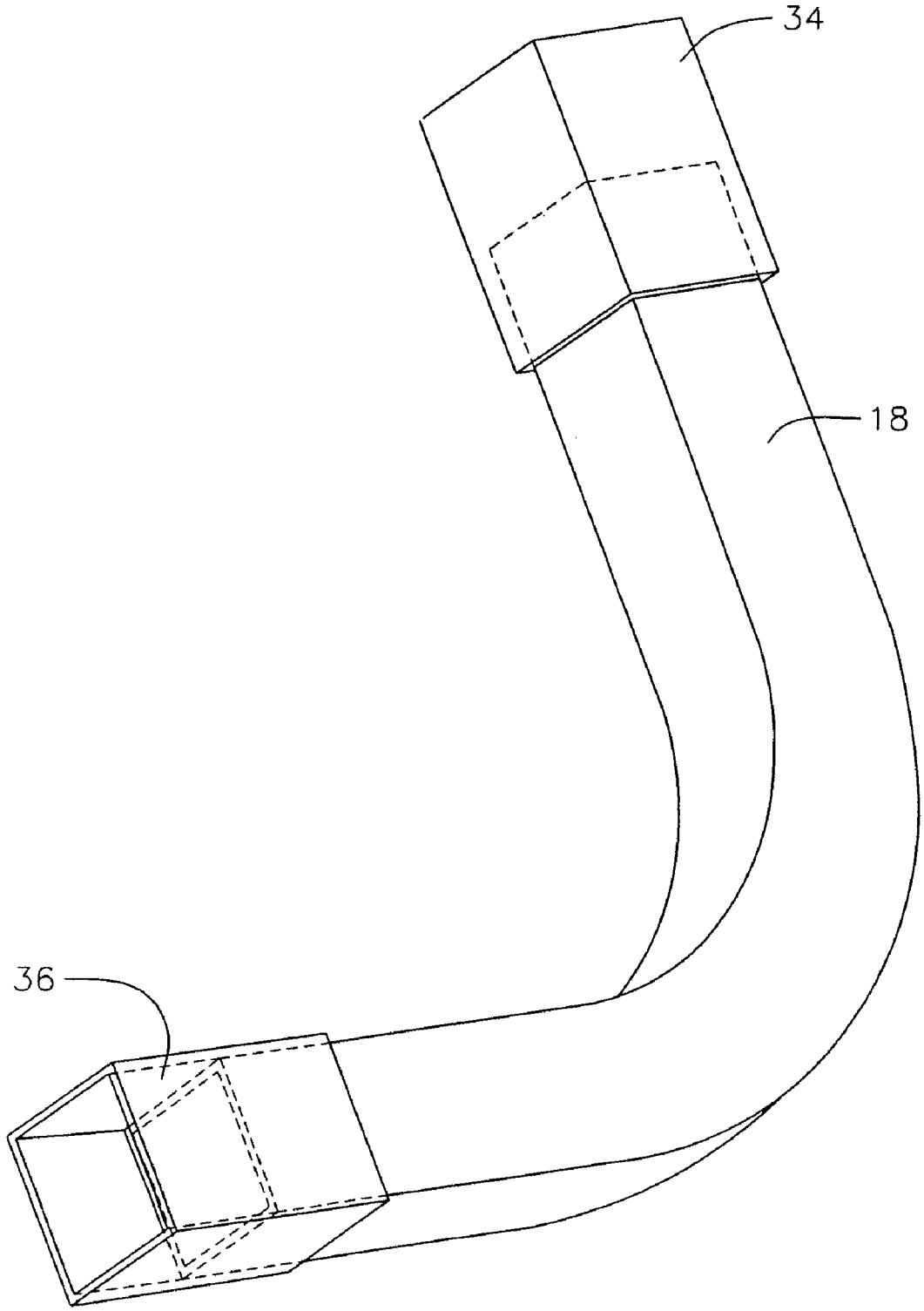
FIG. 3 is a perspective view showing a corner connector.

Referring to FIG. 3, the corner connectors 18 each comprise a rigid metal frame member which is tubular in cross-section and bent into a generally right angle configuration, with a rounded central section. The straight end portions of the tubular corner connectors are elongated and extend along mutually perpendicular axes to form the right angle configuration. A rigid metal open ended connector sleeve 34 is rigidly affixed to one end of each corner connector. A separate open ended connector sleeve 36 is rigidly affixed to the other end of each corner connector. The connector sleeves 34 and 36 are rectangular in cross-section so that the interior of the corner sleeve 34 matches the rectangular exterior configuration of the upper or lower side members 22 or 24. The interior of the connector sleeve 36 matches the rectangular exterior configuration of the upper or lower end members 28 or 30. Thus, during assembly, the upper corner connectors releasably connect end portions of the upper side members to corresponding end portions of adjacent upper end members, and separate lower corner connectors releasably connect end portions of the lower side members to corresponding end portions of adjacent lower end members. The corner connectors in their connected positions, as shown in the assembled form of the foundation in FIG. 1, hold the side frames parallel to one another and hold the end frames parallel to one another to form the rectangular box-frame profile of the assembled foundation.

Figure 4:
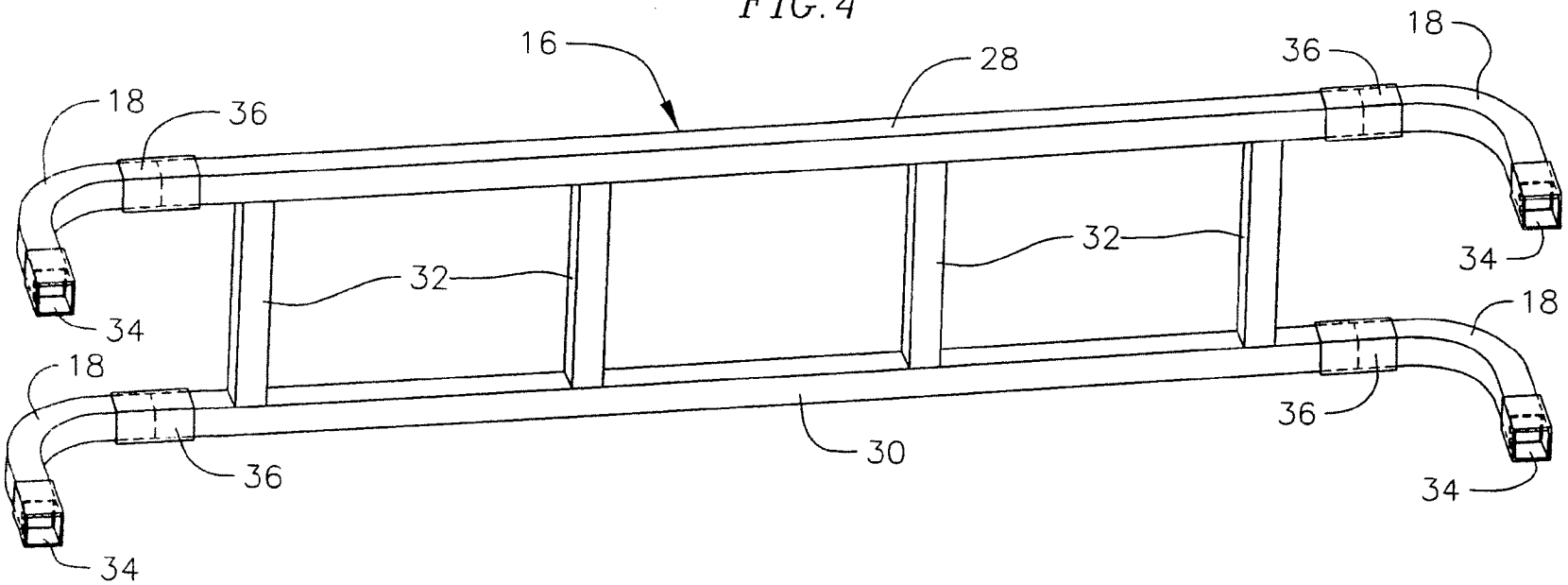
FIG. 4 is a perspective view showing an end frame having releasably attached upper and lower end connectors.
Figure 5:
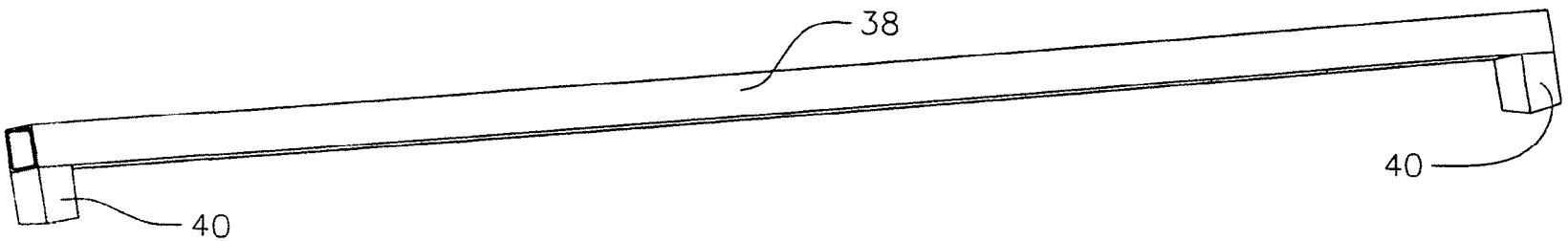
FIG. 5 is a perspective view showing one of a plurality of slats.

FIG. 4 illustrates a partly assembled form of the foundation in which each end frame 16 has four corner connectors releasably attached to the upper and lower ends of the end frame, each making a right angle bend so that the open sleeve portions 34 of the corner connectors face in the direction to receive the end portions of corresponding side frame members 22 or 24.

The foundation assembly further includes a plurality of longitudinally spaced apart tubular rigid metal slats 38 extending parallel to one another between the left and right side frames. Each slat includes side frame connection members 40 at opposite ends of each slat projecting in the same general direction away from the slat. The slats and the connection members 40 are preferably rectangular in cross-section. The side frame connection members 40 extend perpendicular to the axis of slat 38.

Figure 6:
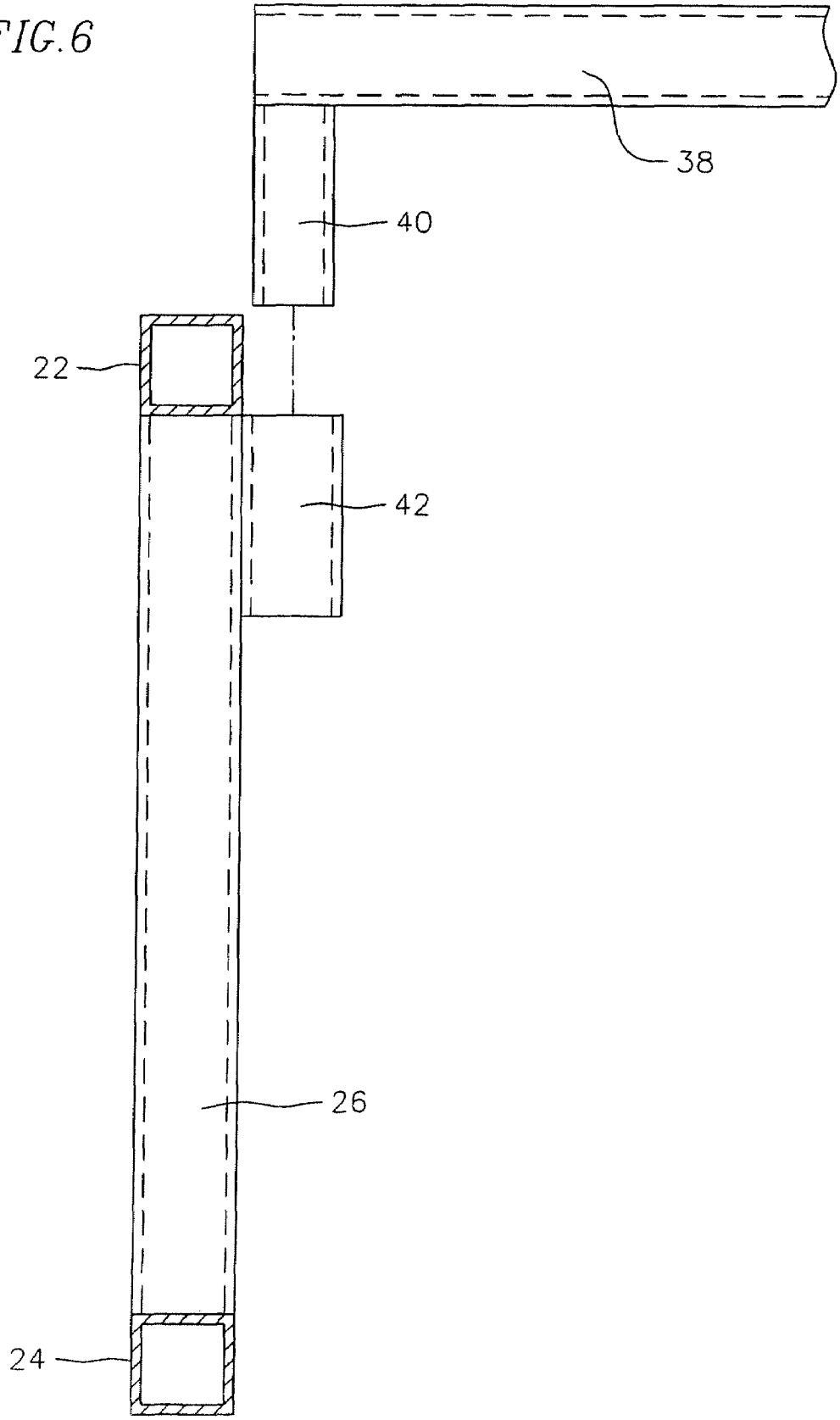
FIG. 6 is a fragmentary side elevational view, partly in cross-section, showing a side frame bracing member supporting a upright slat connector sleeve for releasably receiving an end connector on a slat.

Referring to FIG. 6, each of the first upright bracing members 26 carries a separate rigid tubular metal slat connector sleeve 42 preferably having a rectangular cross-sectional configuration. The slat connector sleeves open upwardly and are shaped and sized to slidably receive the rectangular shaped and downwardly projecting side frame connector members 40 at the ends of the slats 38. Thus, in assembling the foundation, separate rigid slat connector sleeves 42, which are affixed to the first bracing members, slidably receive corresponding ones of the side frame connection members 40 on the slats. The assembled slats are held in fixed spaced apart positions extending parallel to one another between both sides of the side frames and along the length of the box-frame formed by the side and end frames of the assembled foundation. The assembled slats maintain the rigidity of the assembled foundation.

Figure 7:
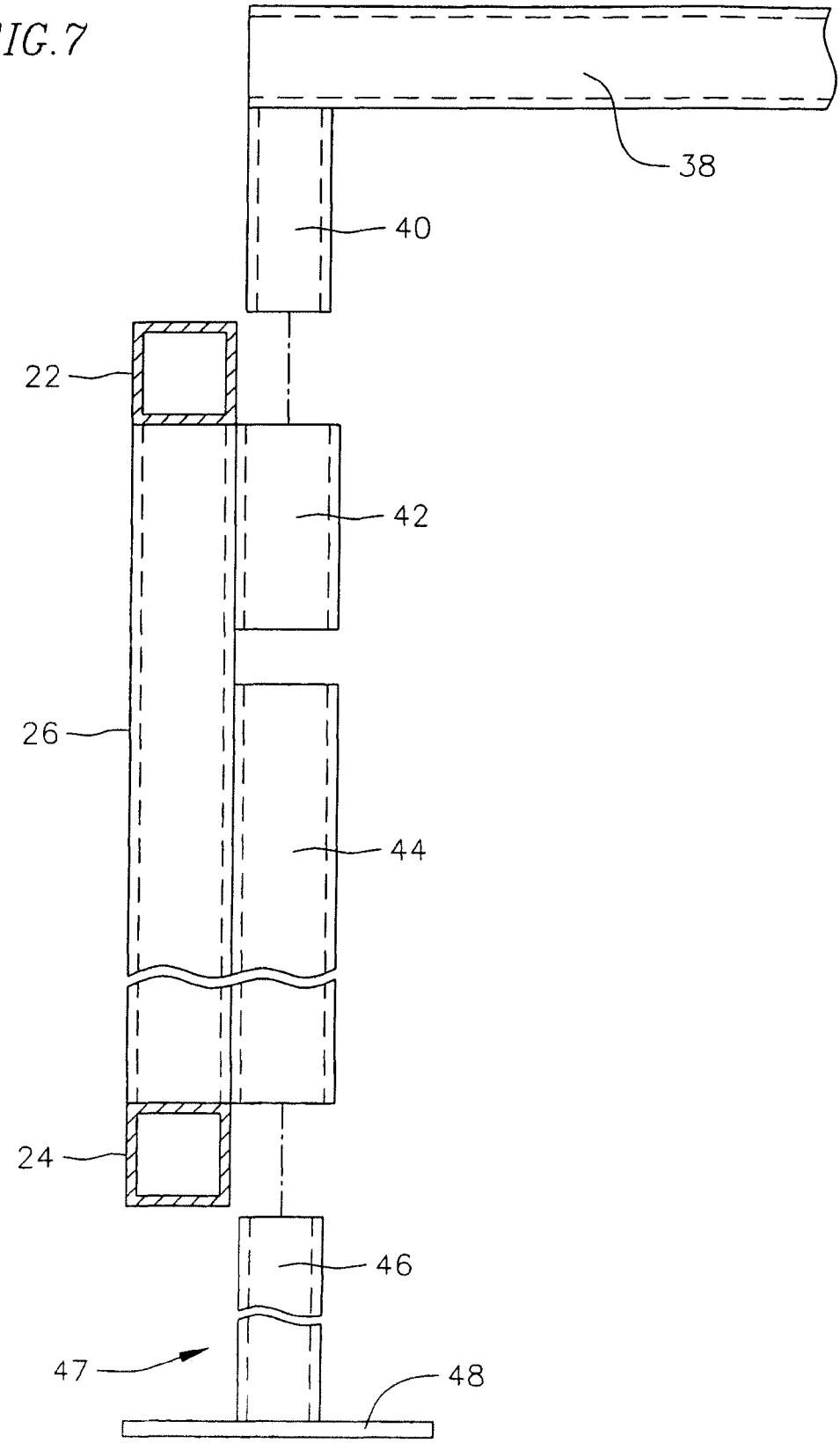
FIG. 7 is a fragmentary end elevational view, partly in cross-section, showing components of the FIG. 6 structure and including a leg connector sleeve for slidably receiving a leg portion of one of several feet that support the assembled foundation in an elevated position above the floor.

Referring to FIG. 7, selected ones of the first upright bracing members 26 also carry a rigid tubular metal leg connector sleeve 44 having a rectangular cross-sectional configuration. The leg connector sleeves open downwardly to slidably receive separate elevating feet 47 for holding the foundation, in its assembled form, elevated above the floor. The elevating feet comprise a separate upright rigid metal leg member 46 of rectangular cross-sectional configuration rigidly affixed to a horizontally extending foot section 48. The separate leg connectors 44 are configured to slidably receive corresponding ones of the leg members 46 for rigidly maintaining the leg members in a fixed position to support the foundation above the floor. A stop (not shown) is located in each of the leg connectors 44 to engage the upper end of the leg 46 so that each of the leg portions of the elevating feet can be spaced a uniform distance above the floor when the legs 46 are assembled in the leg connector sleeves 44.

Thus, the invention provides a modular foundation assembly having ladder-like side frames with upper and lower side rails and ladder-like end frames with upper and lower end rails. The side and end frames slidably attach to the ends of the upper and lower rounded right angle corner rails. The assembled corner connectors hold the side frames and end frames together to form a rectangular box-frame structure. The insides of the side frames carry tubular fittings that provide connector sleeves that receive corner connectors on the ends of spaced apart slats that traverse the width of the box-frame when assembled by the user. The slats extend parallel to one another, perpendicular to the side frames, to provide lateral rigidity between the side frames. The elevating feet can be positioned at least near the four corners of the assembled frame structure. The leg portions of the feet are slidably connected to the socket-like openings in tubular fittings on the undersides of the side frames. The feet elevate the assembled foundation above the floor.

The following description provides one example of carrying out the principles of the invention. The components of the foundation assembly can be provided so as to form either twin, full or double, queen and king size bed foundations.

Full, double and twin size foundations are approximately 5 to 6 feet long, queen size is approximately 6 to 6½ feet long, and king size is approximately 7 feet long. In each instance the slats (and their related bracing members on the side frames) have approximately 12 inch spacing. The frame members described below are preferably made of tubular steel, rectangular in cross-section, preferably made from 16 to 19 gauge steel.

The tubular upper and lower side members 22 and 24 of the side frames are ¾×¾ inch square in cross section.

The upper and lower end members 28 and 30 also are preferably ¾×¾ inch square in cross section.

The tubular corner connectors 18 are preferably ¾×¾ inch in cross section. The sleeves 34 and 36 at their ends are approximately ⅞×⅞ inch square in cross section.

The first and second bracing members 26 and 32 for the side and end frames are spaced apart by about 12 inches and are approximately ¾×¾ inch square in cross section.

For a twin size foundation, the slats 28 and their side frame connection members 40 are ¾×¾ inch in cross section. For full, double, queen or king size foundations, the slats form an integral length of metal tubing each having an outside dimension of ¾×1½ inches in height and width, respectively. Each slat carries a single ¾×¾ inch side frame connection member at each of its ends.

The tubular slat connector sleeves 42 on the upper insides of the left and right side frames are ⅞×⅞ inch square in cross section.

The leg connector sleeves 44 on the lower insides of the left and right side frames also are ⅞×⅞ inch square in cross section.

The leg sections 46 of the elevating feet 47 are preferably ¾×¾ inch square in cross section.

The height of the first and second bracing members of the side frames and end frames can vary in length between about 3 inches for a low profile foundation up to about 8 inches in length for a higher profile foundation.

Figure 8:
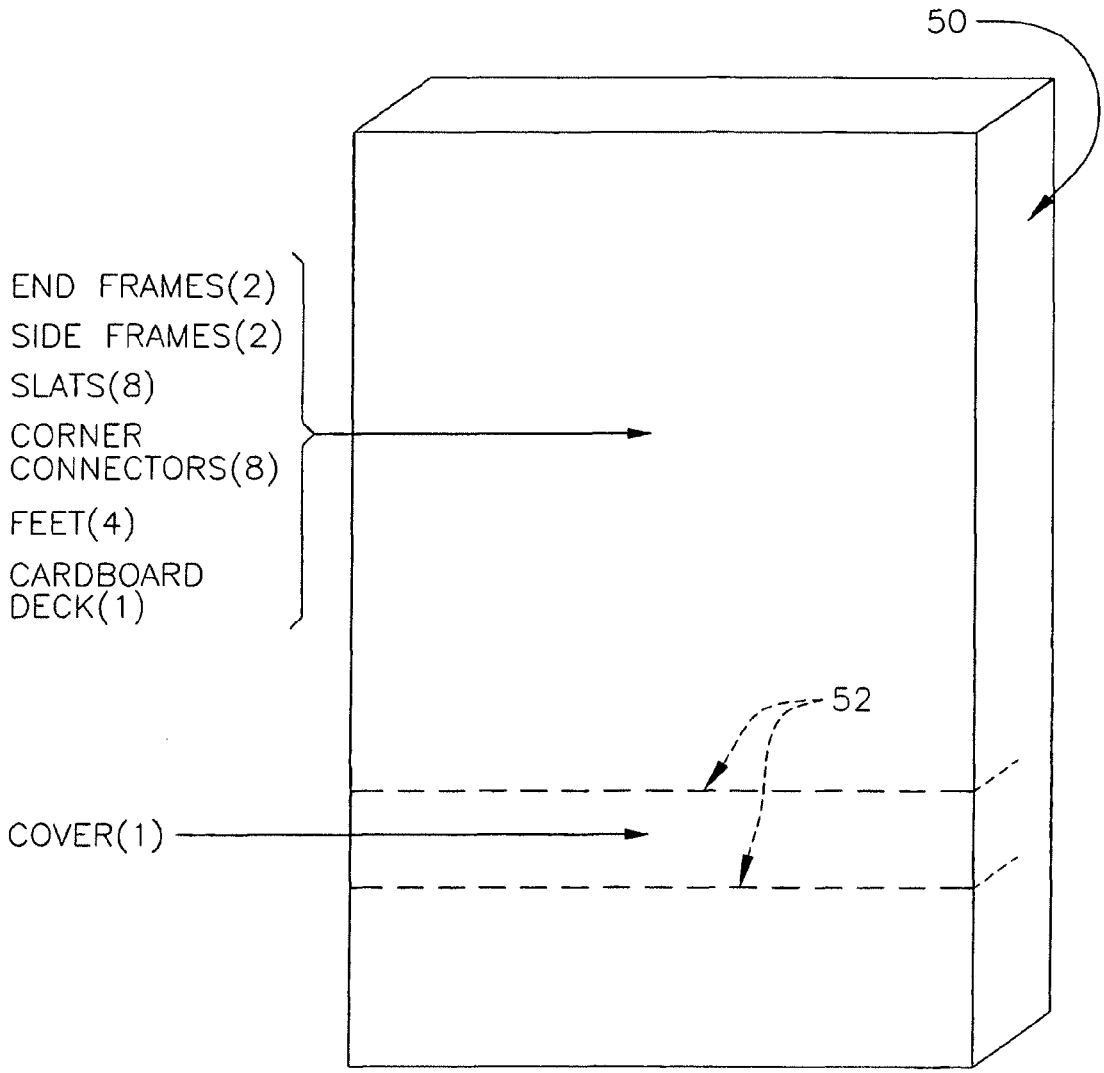
FIG. 8 is a schematic view illustrating components of a kit formed by the components of the foundation assembly and a container for shipping the assembly components in the kit form.

FIG. 8 illustrates another form of the invention in which the components of the foundation assembly can be contained in kit form. A large rectangular cardboard container (approximately 20 inches wide, 8 inches in depth, and 7 feet in height) contains the entire assembly of parts which includes two end frames, two side frames, eight slats, eight corner connectors and four feet. The kit also includes a cardboard deck and a fabric cover.

The cardboard deck is preferably made of heavy duty cardboard. The deck is scored to be folded as an accordion. The deck is adapted to match the length and width of the assembled rectangular foundation frame.

The fabric cover fits over the completed foundation (including the deck) akin to a fitted sheet. The inside of the cover and selected components can include Velcro fasteners for releasably securing the cover to the assembled foundation.

The container can include a perforated section 52 to be opened for inserting the correctly sized cover that matches the particular foundation size.

What is claimed is:

1. A modular bed foundation assembly for supporting a mattress, the assembled foundation comprising:

a pair of laterally spaced apart and parallel left and right side frames;

a pair of longitudinally spaced apart and parallel left and right end frames;

the left and right side frames each comprising upper and lower elongated tubular rigid metal side members spaced vertically apart and extending substantially parallel to one another, and a plurality of longitudinally spaced apart first rigid metal bracing members rigidly affixed in upright positions supporting the upper and lower tubular side members of each side frame;

the left and right end frames each comprising upper and lower elongated tubular rigid metal end members spaced vertically apart and extending substantially parallel to one another, and a plurality of laterally spaced apart second rigid metal bracing members rigidly affixed in upright positions supporting the upper and lower tubular end members of each end frame;

separate elongated tubular rigid metal upper corner connectors each having a generally right angle profile for slidably connecting end portions of the upper side members to corresponding end portions of adjacent upper end members, and separate elongated tubular rigid metal lower corner connectors each having a generally right angle profile for slidably connecting end portions of the lower side members to corresponding end portions of adjacent lower end members, the corner connectors in their connected positions rigidly holding the side frames parallel to one another and the end frames parallel to one another to form a rectangular box-frame profile of the assembled bed foundation;

a plurality of longitudinally spaced apart elongated tubular rigid metal slats extending parallel to one another between the upper side members of the left and right side frames, each slat including elongated tubular side frame connection members integrally formed at opposite ends of each slat and projecting generally at a right angle away from the slat;

separate elongated tubular rigid metal slat connectors rigidly affixed to selected ones of the first bracing members on the left and right side frames, the tubular slat connectors facing upwardly, arranged in corresponding pairs, and configured to slidably receive corresponding ones of the tubular side frame connection members on the slats for holding the plurality of slats in fixed spaced apart positions extending parallel to one another between the upper side members of the left and right side frames along the length of the box-frame formed by the assembled side and end frames of the foundation to thereby form a rigid mattress-supporting platform;

separate upright rigid metal leg members adapted for holding the foundation in an elevated substantially horizontal position above a floor; and separate elongated tubular rigid metal leg connectors rigidly affixed to selected ones of the first bracing members and configured to slidably receive corresponding ones of the leg members for rigidly maintaining the leg members in a fixed position to support the foundation above the floor.

2. The modular bed foundation assembly according to claim 1 in which selected ones of the first bracing members include both a slat connector on an upper portion thereof and a leg connector on a lower portion thereof.

3. The modular bed foundation assembly according to claim 1 in which the leg connectors are tubular and open downwardly to slidably receive a correspondingly configured upper portion of the leg member.

4. The modular bed foundation assembly according to claim 3 including feet affixed to bottom portions of the leg members for resting on the floor.

5. The modular bed foundation assembly according to claim 1 in which the upper side members of the left and right side frames have top edges extending along the length of the assembled foundation at essentially the same elevation, and in which the slats have top edges positioned to substantially correspond with the elevations of the top edges of the left and right side frames.

6. A modular bed foundation assembly comprising:

a pair of left and right side frames;

a pair of left and right end frames;

the left and right side frames each comprising upper and lower elongated tubular rigid metal side members spaced vertically apart and extending substantially parallel to one another, and a plurality of longitudinally spaced apart first rigid metal bracing members rigidly affixed in upright positions supporting the upper and lower tubular side members of each side frame;

the left and right end frames each comprising upper and lower elongated tubular rigid metal end members spaced vertically apart and extending substantially parallel to one another, and one or more second rigid metal bracing members rigidly affixed in an upright position supporting the upper and lower tubular end members of each end frame;

separate elongated tubular rigid metal upper corner connectors each having a generally right angle profile and frame connectors at the ends of the upper corner connectors for slidably connecting end portions of the upper side members to corresponding end portions of adjacent upper end members, and separate elongated tubular rigid metal lower corner connectors each having a generally right angle profile and frame connectors at the ends of the upper corner connectors for slidably connecting end portions of the lower side members; the corner connectors in their connected positions rigidly holding the side frames parallel to one another and the end frames parallel to one another to form a rectangular box-frame profile of the assembled bed foundation;

a plurality of longitudinally spaced apart elongated tubular rigid metal slats, each slat including elongated tubular side frame connection members integrally formed at opposite ends of each slat and projecting generally at a right angle away from the slat; and separate elongated tubular rigid metal slat connectors rigidly affixed to selected ones of the first bracing members on the left and right side frames, the tubular slat connectors facing upwardly, arranged in corresponding pairs, and configured to slidably receive corresponding ones of the tubular side frame connection members on the slats, the side frame connection members positioned for holding the plurality of slats in fixed spaced apart positions extending parallel to one another between the upper side members of the left and right side frames to thereby form a rigid mattress-supporting platform.

7. The modular bed foundation assembly according to claim 6 including separate upright rigid metal leg members; and separate rigid leg connectors rigidly affixed to selected ones of the first bracing members and configured to slidably receive corresponding ones of the leg members.

8. The modular bed foundation assembly according to claim 7 in which selected ones of the first bracing members include both a slat connector on an upper portion thereof and a leg connector on a lower portion thereof.

9. The modular bed foundation assembly according to claim 7 in which the leg connectors are tubular and open downwardly to slidably receive a correspondingly configured upper portion of the leg member.

10. The modular bed foundation assembly according to claim 7 including feet affixed to bottom portions of the leg members for resting on the floor.

11. The modular bed foundation assembly according to claim 6 in which the upper side members of the left and right side frames have top edges extending along the length of the assembled foundation at essentially the same elevation, and in which the slats have top edges positioned to substantially correspond with the elevations of the top edges of the left and right side frames.

* * * * *